US005323674A

United States Patent [19]

Fidkowski

[11] Patent Number: 5,323,674

[45] Date of Patent: Jun. 28, 1994

[54] CORDLESS DRIVE POWER DRIVEN ACCESSORY CLAMP

[76] Inventor: Edward J. Fidkowski, 404 E. Lincoln Ave., Glendale Heights, Ill. 60139

[21] Appl. No.: 9,270

[22] Filed: Jan. 26, 1993

[51] Int. Cl.[5] ..... B25H 3/00

[52] U.S. Cl. ..... 81/487; 81/484; 294/99.1

[58] Field of Search ..... 173/164, 217; 294/99.1, 294/99.2, 19.1; 81/3.4, 53.1-53.12, 421, 484, 487, 488, 180.1

[56] References Cited

U.S. PATENT DOCUMENTS 1,445,908 2/1923 Perkins ..... 81/421 X
1,879,058 9/1932 Brockman .
2,595,683 5/1952 Lo Monte ..... 294/99.2
3,291,476 12/1966 Calkin ..... 294/99.2 X
3,662,297 5/1972 Healis .
3,962,748 6/1976 Michaels ..... 81/484
4,923,234 5/1990 Fairley ..... 294/99.2

*Primary Examiner*—James G. Smith
*Attorney, Agent, or Firm*—Lee, Mann, Smith, McWilliams, Sweeney & Ohlson

[57] ABSTRACT

A clamp for rotating the adjustable mechanism of a hand tool to open and close it. The clamp including spring biased arms forcing upper jaws toward each other to engage the hand tool and a lower shaft engageable with a drive socket of a power tool. The clamp comprising two clamp arms that are spring biased to force the jaws toward each other for gripping the adjustable mechanism of a hand tool. The clamp capable of rotating the hand tool to tighten or loosen it depending upon the rotation of the drive socket.

14 Claims, 1 Drawing Sheet 13
11
12
14
23
25
26
24
21
22
N
N
28
27
29
31
32
30
17
18
35
37
36
19
10
42
43
40
39
38
46
44
47
49
45
50
48
16
15

28
18
30
34
34
26
32
32
A
31
31
A
25
33
33
29
27
17

27
17
31
N
N
31
20
18
42
43
38
46
44
51
47
45

CORDLESS DRIVE POWER DRIVEN ACCESSORY CLAMP

BACKGROUND OF THE INVENTION

The invention in general is directed to providing an aid to operate to close or to open hand tools, and the like, that would otherwise require repetitive turning motions by hand. Specifically, the invention is directed toward an accessory clamp that may be rotated by a cordless drive device for opening and closing hand tools such as C-clamps, vises, vise grips and the like.

Various hand tools require tightening by means of turning a helical threaded shaft for closing jaws or other gripping portions, such as C-clamp or vise grips. It is necessary to rotate these threaded portions by hand to the closed or open position. This activity is required for the amateur hobbyist, homeowner/do-it-yourself worker, as well as professional craftsmen and skilled artisans. The task of opening and closing these clamping-type devices is time consuming and requires repetitive rotating motions which often require two hands and can be the source of tendinitis or other musculoskeletal debilitations.

Accordingly, it is a primary goal of the invention to provide a clamp for releasably attaching to the locking portions of a hand tool and having the capability of being drivingly attached to a powered driver for rotation of the tool's adjustable mechanism of the type that is normally turned by hand.

It is a further goal of the invention to provide an accessory clamp which resiliently grips a rotatable portion of a hand tool for closing and opening it and includes a driveable shaft engageable with the drive socket of a power source, such as an electric screwdriver or drill.

It is also a goal of the invention to provide a clamp engageable with a drive socket of a cordless electric power tool, such as a cordless drill or screwdriver operating at low RPM's and relatively high torque for operably rotating the threaded adjustment member of a hand tool.

It is another object of the invention to provide a drive socket-engageable portion of an accessory clamp that includes an overload release to prevent the motor of the power source from operating against a jammed or locked tool held by the tool gripping portion of the accessory clamp.

It is yet another allied goal of the invention to provide for an accessory clamp for gripping, at one end, the rotatable portion of a tightenable hand tool at opposing gripping jaws capable of engaging a variety of configurations for the hand-adjustable tightening portions of various hand tools, and at the other end being capable of attachment to a cordless power tool for the driving rotation thereof.

It is further an auxiliary objective of the invention to provide for an accessory clamp that includes opposing jaw-like members that float loosely relative to each other to compensate for and grippingly accommodate variously shaped hand tools.

SUMMARY OF THE INVENTION

The invention may be summarized as a hinged accessory clamp having a pair of re-bent arms spring biased together to provide for two opposing upper surfaces holding gripping jaws for attachment to the operable mechanism of a closable hand tool, or the like. The hinge is at a clamp end opposite the jaws and includes an open tubular member for receiving a shaft to be fastened therein. The shaft being engageable, for example, with a hex drive of an electric power tool for the driving rotation thereof. The shaft further includes anti lock-up means, preferably in the form of biased retractable ballbearings, to prevent the locking-up or freezing when the limit of travel of the hand tool adjustment is reached.

The opposing gripping jaws are loosely held to be able to float opposite each other in relative independent motion to accommodate for deformities or odd-shaped engageable portions of a hand tool. The re-bent arms of the clamp are pivotally joined at lower arm portions thereof at the hinge and are resiliently biased by a compressed spring.

DESCRIPTION OF THE PREFERRED EMBODIMENT

Figure 1:
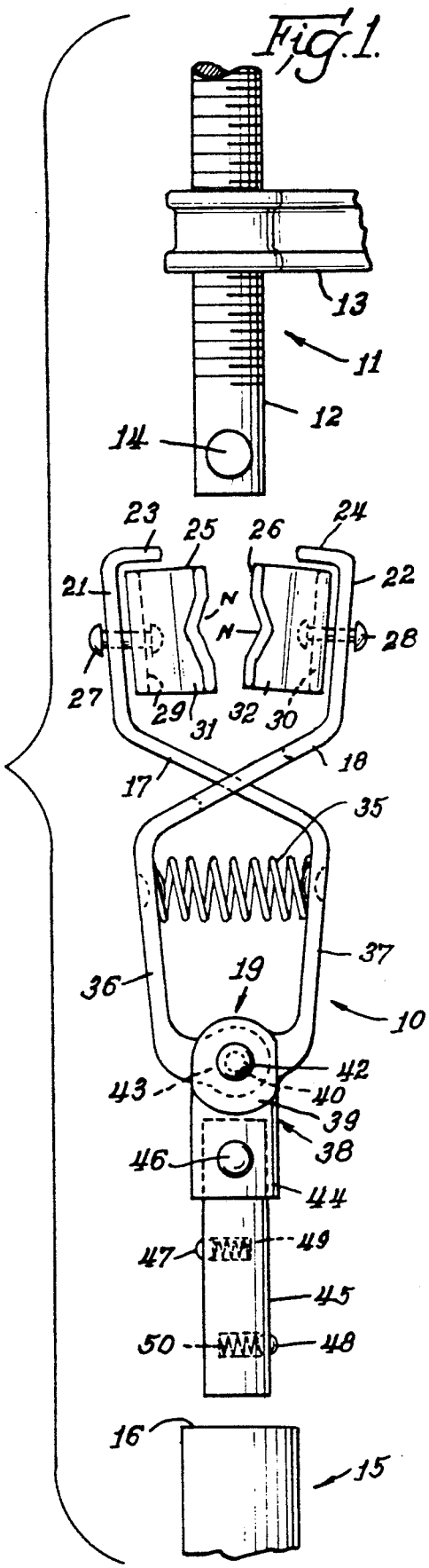
FIG. 1 is an exploded side view of the accessory clamp arranged below a pinned threaded rod of a C-clamp and above the hex drive socket of an electric power tool.

With respect to the drawings, like reference numerals are used throughout to refer to the same elements.

In FIG. 1, the preferred embodiment for the accessory clamp of the invention is generally denoted at 10. The accessory clamp 10 is intended for temporary clamping engagement to work tools, preferably hand tools of the type that are tightened or loosened by the person rotating a threaded shaft, such as a C-clamp 11. The C-clamp 11 includes a threaded shaft 12, thread engaging a clamp frame 13 and a transverse pin 14 used by the operator for grasping and turning the shaft 12 clockwise or counterclockwise for loosening or engaging the clamp 11 in a known manner. The accessory clamp 10 is driveable by an electrical power driver or tool, preferably of the cordless variety, as generally denoted at 15, which has a drive-engage, able socket 16. In the preferred embodiment the socket 16 is a hex drive socket commonly found in hand-held cordless electric screwdrivers and drills. When accessory clamp 10 clampingly engages the pin 14 of C-clamp 11 at one end thereof and is inserted in the hex drive socket 16 of the power driver 15 at the opposite end thereof, actuation of the power drive 15 will rotate the accessory clamp 10 and thereby the threaded shaft 12 either clockwise or counterclockwise, as desired, to open or close the C-clamp 11.

Figure 3:
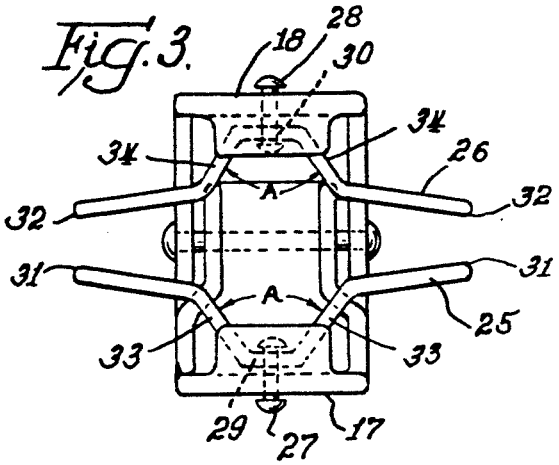
Figure 2:
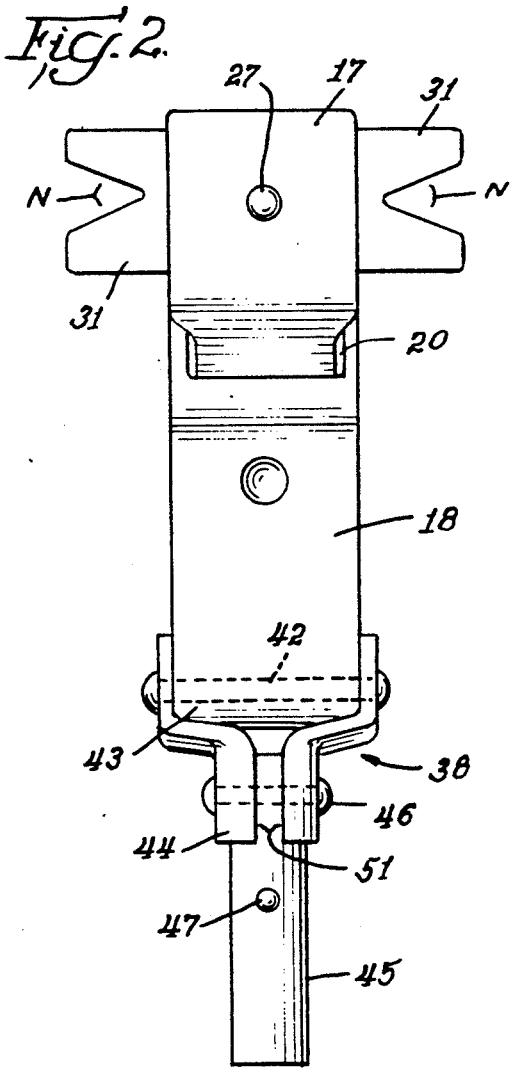
FIG. 2 is a front view of the accessory clamp looking from the left-hand side of FIG. 1; and, FIG. 3 is a top view of the accessory clamp looking into the jaws thereof.

With more specific derailed reference, the accessory clamp 10 disclosed is primarily comprised of opposingly arranged wide arms comprising a main clamp arm 17 and secondary clamp arm 18. The clamp arms 17 and 18 are hinged at 19, as will be further explained hereinafter. With reference to FIGS. 1-3 collectively, it will be seen that the secondary clamp arm 18 includes a pass-through slot 20 through which the main clamp arm movably resides. The clamp arms 17 and 18 have opposing upper arm portions 21, 22, with opposingly directed flanges 23, 24, respectively. The opposing upper arm portions 21, 22 loosely retain clamping jaws 25, 26, respectively, facilitating the gripping of a hand tool adjustment means, such as pin 14. The clamping jaws 25, 26 are retained by rivet fasteners 27, 28, respectively, loosely attaching, or tethering, them to the opposing upper arm portions 21, 22. Thereby, the gripping jaws 25, 26 are in a floating condition allowing for various shapes and angular differences to be accommodated for attachment to the operable adjustment portions of hand tools and the like. The opposing flanges 23, 24 are formed at fight angles to the upper arm portions 21, 22, respectively, and are provided to keep the gripping jaws 25, 26 from turning or slipping upwardly out of clamping engagement. The gripping jaws 25, 26 are formed with recessed flats 29, 30 to accommodate and clear the rivets 27, 28, respectively. The gripping jaws 25, 26 extend transversely outward from, and have a greater width than, the clamping arms 17, 18, as best viewed in FIGS. 2 and 3, whereby to be able to surely grip a variety of rotatable tightening means of hand tools, such as butterfly-shaped grips, elongate pins, knobs, hex nuts, wing nut shapes, and the like, as would be understood by one skilled in the art. In that regard, the distal ends 31, 32 of the gripping jaws 25, 26 are convergent, as viewed in FIG. 3, and include V-shaped notches N. The V-notches N are preferred in that they serve to wedgingly grip the manually rotatable adjustment portions of many hand tools. The converging relationship of the ends 31, 32 also aids in a tight grasping effect, as will be further explained.

In the disclosed embodiment, the flat portions 29 and 30 are intermediate and join angled webs 33, 34, respectively, of the gripping jaws 25, 26. The angled webs 33, 34 each define an angle A therebetween of from about 90° to 120° to aid in accommodating the various shapes of the adjustment mechanisms C-clamps, vise-grips, bench vises, etc.

The clamping arms 25, 26 are preferably rubber coated for additional tacky gripping contact with the tools to be rotated.

In the disclosed form of the invention, the clamp arms 17 and 18 are spring biased to urge the gripping jaws 25, 26 toward each other by means of a helical compression spring 35. The spring 35 is in compression and exerts outward force which moves lower opposing arm 36, 37, of the main clamp arms 17, 18, away from each other while at the same time urging the upper arms 21, 22 toward each other. The upper arms 21, 22 extending generally in the same direction, and generally parallel to, the lower arms 36, 37. This results because the lower arms 36, 37 curl toward each other and are joined at said hinge 19. It will be seen from FIG. 1 that the main clamp arm 17 terminates at its lower end in a housing 38. The housing 38 includes a generally transverse cylindrical portion 39 with a bore 40 therethrough. The bore 40 accommodates a pin extending therethrough and through a coaxial hub 43 at the lower end of the secondary clamp arm 18. Thereby, the clamp arms 17, 18 are relatively pivotal at pivot 19. The housing 38 further includes a vertical oriented tube 44 for receipt therein of a shaft 45. The shaft 45 is mechanically pinned to the tube 44 by a rivet 46 and extends downwardly therefrom. The shaft 45 carries a safety release mechanism in the form of ballbearings 47, 48 which are outwardly biased by spring 49, 50, respectively. The ballbearings 47, 48 are preferably arranged on the shaft 45 generally at 180° spacing and define an outside diameter of approximately 0.275–0.300 inches, in the exemplary, embodiment for engagement in a hex drive socket of a cordless power drill having a standard ¼ inch nominal size. Of course, other dimensions can be created for engagement with different size drive sockets, or the like. Thereby, the diameter of shaft 45, and outside diameter defined around the ballbearings 47, 48, can be varied.

The purpose of the shaft 45 is for it to be placed into the socket 16, for example, which, as noted, is preferably a hex drive socket for a power tool 15. The ballbearing function is to keep the shaft 45 snug in the hex drive socket 16, but when the limits of travel are reached for rotating the threaded shaft 12 relative to the clamp arm 13 of the C-clamp 11, the ballbearings 47, 48 will be forced against the springs 49, 50, respectively, and retract inwardly of the outer periphery of the shaft 45. The shaft 45 will then spin freely in the rotating hex drive socket 16 to prevent locking-up or freezing, which could result in damage to the motor of the power tool 15.

In the depicted embodiment, the helical spring 35 exerts in the range of 12–15 pounds of force to yield sufficient gripping pressure at the jaws 25, 26 for clamping and rotating most hand tools.

The accessory clamp 10 can be driven clockwise or counterclockwise without changing the grip on the pin 14.

It will be further appreciated that the tube 44 of the housing 38 can be formed with an open slot 51 whereby the housing 38 and clamp arm 17, and the hub 43 and clamp arm 18, need not be cast as unitary constructions. Thereby, the material for the clamping arms 17, 18 may be made of sheet or spring steel and the metal being cold formed into the shown configurations.

It will be understood by those skilled in the art that the invention is not limited to use with hexagonal shaped drive sockets of power tools, nor is the ballbearing arrangement, at 47, 48, limited to two locations. The numbers of ballbearings and the overload pressure characteristics of the springs 49 and 50 can be varied to make the shaft 45 to spin free when the tool engaged thereto has been tightened or loosened to its full travel. Of course, other known release means, such as wire springs, leaf springs, clutch-type devices, dry wall screwdrivers, and the like, may be used to release the shaft and prevent overload.

The foregoing has been a description of a preferred embodiment of the invention but a wider range of embodiments fall within the scope of the claims appended hereto.

What is claimed is:

1. A clamp for attachment to a power driving tool for the purpose of rotatable adjustment of a hand tool of the type requiring an adjustment mechanism to be rotated to operate the hand tool, said clamp comprising:

first and second clamp arms, each having opposing upper arms and opposing lower arms joined by intermediate arms, the intermediate arm of the second clamp arm having a slot for receipt therethrough of the intermediate arm of the first clamp arm, said upper arms including means for gripping a hand tool, said lower arms having therebetween a means for resiliently biasing said first clamp arm relative to said second clamp arm, said lower arms including lower ends thereof being rotatably joined at means for pivoting said first clamp arm relative to said second clamp arm and a downwardly opening means for receipt of a shaft therein, said means for receipt of a shaft extending from said means for pivoting said first and second clamp arms, a shaft engaged within said means for receipt of a shaft, said shaft including means for releasable engagement from a drive socket of a power driving tool, said means for releaseable engagement comprising shaft-outwardly biased ballbearings retractable into said shaft upon receiving an overload force of a precalculated valve;

said means for gripping a hand tool being loosely attached to the opposing upper arms of the first and second clamp arms and including intermediate segments thereof for receipt of a mechanical fastener for loosely fastening said means for gripping a hand tool to said first and second clamp arms, said means for gripping a hand tool extending transversely from said upper arms of the first and second clamp arms; and, said means for resiliently biasing said first clamp arm relative to said second clamp arm extending between the opposing said lower arms and being biased to force said means for gripping a hand tool toward each other for gripping a hand tool therebetween.

2. The clamp as claimed in claim 1 wherein said upper arms of the first and second clamp arms include opposingly directed flanges for retaining therebelow said means for gripping a hand tool.

3. The clamp as claimed in claim 1 wherein said means for resiliently biasing said first clamp arm relative to said second clamp arm comprises a helical coiled spring.

4. The clamp as claimed in claim 1 wherein said means for pivoting comprises a housing formed with the lower arm of said first clamp arm and receiving therein a rotatable hub formed with the lower arm of said second clamp arm, said housing and hub having coaxial bores therethrough, and a pivot pin pivotally engaged through said bores, whereby said first clamp arm may pivot relative to said second clamp arm.

5. The clamp as claimed in claim 4 wherein said housing is formed with said means for receipt of a shaft.

6. A spring biased clamp having a downwardly open tube for receipt of a shaft, a shaft being mechanically fastened within said tube and extending longitudinally therefrom, the shaft capable of being inserted into the rotatable drive socket of a power tool, said shaft including means for releasing the shaft from rotatable drive engagement with a power tool upon receiving an overload force of a precalculated value, the shaft being joined to a means for pivoting, said means for pivoting comprising a housing and a hub, the housing being joined to a main clamp arm, the main clamp arm including a main lower arm extending from said housing, an angled main intermediate arm extending from an opposite end of the main lower arm, and a main upper arm extending from the main intermediate arm in a direction generally parallel to said main lower arm, said hub being formed with a secondary clamp arm, the secondary clamp arm having a secondary lower secondary arm extending from said hub, an angled secondary intermediate arm extending from an opposite end of the secondary lower arm, the secondary intermediate arm having a slot receiving therethrough said main intermediate arm of said main clamp arm and terminating in an secondary upper arm extending generally parallel to said secondary lower arm, said main and secondary upper arms being loosely engaged with opposing means for gripping, said spring biased clamp further including means for resiliently biasing said main and secondary clamp arms whereby to urge said means for gripping toward each other.

7. The clamp as claim in claim 6 wherein said means for releasing comprises shaft-inwardly retractable spring-loaded ballbearings.

8. In combination, an electrically operated rotatable power drive tool, a hand tool comprising at least a manually operable mechanism, an accessory clamp having means for engagement with the power drive tool at one end thereof, and at an opposite end thereof, means for gripping said manually operable mechanism of the hand tool, whereby upon operation of the electric power drive tool, said accessory clamp rotates to rotate the manually operable mechanism of the hand tool for loosening or tightening thereof, said electric power drive tool including a drive socket, said means for engagement with a power drive tool including a shaft engaged with said drive socket and including means for releasable disengagement with said drive socket upon receiving a radial force of a preset overload value, said shaft being engaged to the accessory clamp at a tube formed with the accessory clamp, said accessory clamp including a means for pivoting, said means for pivoting joining first and second double-bent arms, the double-bent arms including upper opposing arms and lower opposing arms, said upper opposing arms loosely holding said means for gripping and said means for gripping being resiliently biased toward each other, and a spring extending between said opposing lower arms to provide said resilient biasing.

9. The combination as claimed in claim 8 wherein said electrically operated power drive tool comprises a cordless electric drill.

10. The combination as claimed in claim 8 wherein said electrically operated power drive tool comprises a cordless electric screwdriver.

11. The combination as claimed in claim 8 wherein said means for gripping a manually operable mechanism of a hand tool comprises opposing jaws each having two intermediate angled web portions the angled web portions having extending therefrom oppositely directed arms extending transversely outwardly of both said opposing upper arms of the first and second double-bent arms.

12. The combination as claimed in claim 11 wherein said opposing jaws each include central flat sections loosely held to said opposing upper arms of the first and second double bent arms by means of a rivet loosely tethering said jaws to said upper arms, whereby said jaws being capable of independent movement relative to each respective upper arm.

13. The combination as claimed in claim 8 wherein one of said double bent arms passes through a slot in the other double bent arm for relative motion therebetween.

14. The combination as claimed in claim 8 wherein said means for gripping a hand tool are coated with a rubberized material.

* * * * *